US009492693B2

(12) United States Patent
Byrd

(10) Patent No.: US 9,492,693 B2
(45) Date of Patent: Nov. 15, 2016

(54) SLIDE BAR ANCHORAGE DEVICE FOR AERIAL LIFT EQUIPMENT

(71) Applicant: Michael Byrd, Willow Spring, NC (US)

(72) Inventor: Michael Byrd, Willow Spring, NC (US)

( * ) Notice: Subject to any disclaimer, the term of this patent is extended or adjusted under 35 U.S.C. 154(b) by 78 days.

(21) Appl. No.: 14/496,745

(22) Filed: Sep. 25, 2014

(65) Prior Publication Data

US 2016/0023023 A1 Jan. 28, 2016

Related U.S. Application Data

(60) Provisional application No. 62/029,236, filed on Jul. 25, 2014.

(51) Int. Cl.
*A62B 35/00* (2006.01)
*B66F 17/00* (2006.01)

(52) U.S. Cl.
CPC ..... *A62B 35/0068* (2013.01); *A62B 35/0081* (2013.01); *B66F 17/006* (2013.01)

(58) Field of Classification Search
CPC ..... A62B 35/0068; A62B 35/0075; A62B 35/00; B66F 11/04; B66F 9/127; A47L 3/02
See application file for complete search history.

(56) References Cited

U.S. PATENT DOCUMENTS 4,099,595 A * 7/1978 Tracy ..... A62B 1/20 182/48
4,160,492 A * 7/1979 Johnston ..... B66F 11/046 182/148
4,515,244 A * 5/1985 Kramer ..... A62B 1/04 182/100
4,763,755 A * 8/1988 Murray ..... B66F 11/044 182/2.2
4,883,145 A * 11/1989 Deltatto ..... B66F 11/044 182/2.4
5,386,784 A * 2/1995 Meier ..... E06C 5/00 105/326
5,406,816 A * 4/1995 Thomas ..... B62J 7/06 224/414
5,813,486 A * 9/1998 Smith ..... E04G 21/3261 182/3
5,887,927 A * 3/1999 Kurek, III ..... A45C 13/26 16/415
6,265,983 B1 * 7/2001 Baillargeon ..... A62B 35/0037 340/673
7,353,817 B2 * 4/2008 Kobel ..... A62B 1/22 125/12
D657,114 S * 4/2012 Anasis ..... D34/37

(Continued)

OTHER PUBLICATIONS

Occupational Safety and Health Administration (OSHA); Code of Federal Regulations (CFR), Title 29—Labor, Part 1926—Safety and Health Regulations for Construction, Subpart M—Fall Protection, Section 1926.502—Fall protection systems criteria and practices; 29 CFR 1926.502; United States Government Publishing Office, Washington, DC; Jan. 1, 2015 (8 pages).

*Primary Examiner* — Alvin Chin-Shue
*Assistant Examiner* — Shiref Mekhaeil
(74) *Attorney, Agent, or Firm* — Taft Stettinius & Hollister LLP; Anthony Filomena, II

(57) ABSTRACT

Anchorage devices for an aerial lift that can include a base plate and a slide bar coupled to the base plate. The aerial device can include a bucket, and the base plate can be coupled to the inside or outside of the bucket. Supplementary anchorage points of the anchorage device can be attached to the lift using lanyards. The slide bar can be attached to the base plate using stanchions. A removable anchorage device can include inner and outer mounting bars, bucket engaging brackets coupling the mounting bars, and a slide bar; where the bucket engaging brackets fit over the bucket for attachment to and detachment from the bucket. The removable anchorage device can include supplementary anchorage points for attaching to the lift using lanyards. One of the mounting bars can be hollow and a supplementary lanyard attached to the lift can pass through the hollow mounting bar.

9 Claims, 6 Drawing Sheets

(56) References Cited

U.S. PATENT DOCUMENTS 8,257,008 B2 * 9/2012 Ellingson ..... B66F 9/127 182/14
8,276,712 B2 * 10/2012 Smith ..... A62B 35/0037 119/796
8,651,237 B2 * 2/2014 Pulliam ..... B66F 11/044 182/141
9,221,660 B2 * 12/2015 Chard ..... B66F 17/00
2002/0170783 A1 * 11/2002 Goode ..... A62B 1/22 187/240
2008/0149420 A1 * 6/2008 Cheatham ..... B66F 11/04 182/63.1
2010/0147624 A1 * 6/2010 Caylor ..... A62B 1/04 182/129
2010/0314197 A1 * 12/2010 Lagerstedt ..... A62B 1/04 182/5
2011/0168486 A1 * 7/2011 Dobrovolsky ..... A62B 1/02 182/3
2013/0193290 A1 * 8/2013 Lohmann ..... B60R 11/0252 248/276.1
2014/0138183 A1 * 5/2014 Chard ..... B66F 17/006 182/46
2015/0027808 A1 * 1/2015 Baillargeon ..... B66F 17/006 182/3
2015/0314150 A1 * 11/2015 LaRue ..... A62B 35/0018 182/3

* cited by examiner

SLIDE BAR ANCHORAGE DEVICE FOR AERIAL LIFT EQUIPMENT

This application claims priority to U.S. Provisional Patent Application Ser. No. 62/029,236, filed Jul. 25, 2014 entitled "Personal Fall Protection/Restraint Device for Aerial Lift Equipment and Bucket Trucks for Worker Protection with Two Options 'Slide Bar Anchorage Device' and 'Inside Slide Bar Anchorage Device'", the disclosure of which is expressly incorporated herein by reference.

BACKGROUND AND SUMMARY

The present invention generally relates to fall protection/restraint devices, and more specifically to personal fall protection/restraint devices for worker protection while working in bucket trucks or other aerial lift equipment.

Effective Apr. 15, 2015, according to the Occupational Safety and Health Administration (OSHA) Standard 29 C.F.R. §1926.502(d)(16)(iii), personal fall arrest systems when stopping a fall from an aerial lift shall "be rigged such that an employee can neither free fall more than 6 feet (1.8 m), nor contact any lower level" if ejected from the aerial lift.

For years electrical workers have been wearing a full body harness and a six-foot shock absorbing lanyard for fall protection in case they were ejected while working in an aerial lift truck. One end of the six-foot lanyard was connected to a D-ring on the back of the full body harness that the worker was wearing. The other end of the lanyard was connected to a predetermined anchorage point designed by the truck manufacturer on either the truck boom or bucket. Due to the emphasis on fall protection and more enforcement by OSHA, after Apr. 15, 2015 the six-foot lanyard will no longer be a compliant fall protection system until the worker is clear of all obstacles that would be hit if the worker was ejected from the aerial lift bucket with only a six-foot lanyard to stop the fall. When the worker is raising the bucket out of its cradle and working over the top of elevated obstructions, including the bed of the aerial lift truck, the six-foot lanyard is not likely to be able to stop the workers fall before the worker contacts a lower level obstruction.

If a shorter lanyard is used, the current factory-installed anchorage points will limit a worker's ability to move around on the aerial lift and perform work. It would be desirable to have a fall protection/restraint system that meets OSHA regulations while also allowing the worker to more easily and comfortably move around in the aerial lift and perform assigned tasks.

Embodiments of the disclosed fall protection/restraint system can relocate and/or provide alternative anchorage points for fall protection/restraint other than the anchorage point(s) typically provided for an aerial lift bucket truck, or other type of aerial lift device. Embodiments of the disclosed fall protection/restraint system can allow freedom of movement for the worker while using a shorter (less than six foot) fall protection lanyard and can provide for the worker's safety. These fall protection/restraint devices can be designed to be installed in various locations on the aerial lift, for example on the outside of a bucket, or the inside of a bucket, or the floor of a bucket or aerial lift. The fall protection/restraint devices can be designed to be as large or as small as required. Two or more of the fall protection/restraint devices can be installed to accommodate more workers if needed.

An anchorage device for an aerial lift is disclosed that includes a base plate for coupling to the aerial lift, and a slide bar having a length between a first end and a second end where the first and second ends of the slide bar are coupled to the base plate. When a lanyard coupler is attached to the slide bar, the lanyard coupler can move along the length of the slide bar between the first and second ends of the slide bar. The slide bar can be U-shaped. The slide bar can be coated with an insulating material. The aerial device can include a bucket, and the base plate can be coupled to the inside or the outside of the bucket.

The base plate can be coupled to the aerial lift using an adhesive. The anchorage device can also include a mounting plate, where the mounting plate is attached to the aerial lift and the base plate is attached to the mounting plate. The mounting plate can be attached to the aerial lift using an adhesive, and the base plate can be attached to the mounting plate using bolts.

The anchorage device can include a supplementary anchorage point for attaching to the aerial lift using a supplementary lanyard, where the supplementary anchorage point is coupled to the base plate. In this embodiment, if the base plate detaches from the aerial lift when a supplementary lanyard is attached between the supplementary anchorage point and the aerial lift, the supplementary lanyard attached to the supplementary anchorage point restrains falling of the anchorage device.

The anchorage device can include first and second stanchions extending from base ends to upper ends; where the base ends of the first and second stanchions are attached to the base plate, the first end of the slide bar is attached to the upper end of the first stanchion, and the second end of the slide bar is attached to the upper end of the second stanchion. In this embodiment, when a lanyard coupler is attached to the slide bar, the lanyard coupler can move along the length of the slide bar between the first and second stanchions.

The anchorage device can also include a supplementary anchorage point for attaching to the aerial lift using a supplementary lanyard, where the supplementary anchorage point is coupled to one of the first and second stanchions. In this embodiment, if the base plate detaches from the aerial lift when a supplementary lanyard is attached between the supplementary anchorage point and the aerial lift, the supplementary lanyard attached to the supplementary anchorage point restrains falling of the anchorage device.

A removable anchorage device is disclosed for attaching to a bucket of an aerial lift, where the bucket has a lip. The removable anchorage device includes inner and outer mounting bars, first and second bucket engaging brackets, and a slide bar. Each of the first and second bucket engaging brackets couples the inner and outer mounting bars. The slide bar has a length between a first end and a second end, where the first and second ends of the slide bar are coupled to the inner mounting bar. The first and second bucket engaging brackets are shaped to fit over the lip of the bucket so the removable anchorage device can be removably attached to and detached from the bucket. When attached to the bucket, the outer mounting bar is on the outside of the bucket and the inner mounting bar is on the inside of the bucket. When a lanyard coupler is attached to the slide bar, the lanyard coupler can move along the length of the slide bar between the first and second ends of the slide bar. The slide bar can be U-shaped. The slide bar can be coated with an insulating material.

The removable anchorage device can also include a supplementary anchorage point for attaching to the aerial lift using a supplementary lanyard, where the supplementary anchorage point is coupled to one of the inner and outer mounting bars. In this embodiment, if the anchorage device detaches from the aerial lift when a supplementary lanyard is attached between the supplementary anchorage point and the aerial lift, the supplementary lanyard attached to the supplementary anchorage point restrains falling of the anchorage device.

The removable anchorage device can also include a supplementary lanyard for attaching to the aerial lift, and at least one of the inner and outer mounting bars can be hollow. The supplementary lanyard can pass through the at least one hollow mounting bar of the inner and outer mounting bars so that the anchorage device detaches from the aerial lift when the supplementary lanyard is attached to the aerial lift, the supplementary lanyard restrains falling of the anchorage device.

The removable anchorage device can also include first and second stanchions, each extending from a base end to an upper end. The base ends of the first and second stanchions can be attached to the inner mounting bar, the first end of the slide bar can be attached to the upper end of the first stanchion, and the second end of the slide bar can be attached to the upper end of the second stanchion, such that when a lanyard coupler is attached to the slide bar, the lanyard coupler can move along the length of the slide bar between the first and second stanchions.

The removable anchorage device can also include a supplementary anchorage point for attaching to the aerial lift using a supplementary lanyard, where the supplementary anchorage point being coupled to one of the first and second stanchions. In this embodiment, if the anchorage device detaches from the aerial lift when a supplementary lanyard is attached between the supplementary anchorage point and the aerial lift, the supplementary lanyard attached to the supplementary anchorage point restrains falling of the anchorage device.

The removable anchorage device can also include a supplementary lanyard for attaching to the aerial lift, and at least one of the inner and outer mounting bars can be hollow such that the supplementary lanyard can pass through the at least one hollow mounting bar of the inner and outer mounting bars. In this embodiment, if the anchorage device detaches from the aerial lift when the supplementary lanyard is attached to the aerial lift, the supplementary lanyard restrains falling of the anchorage device.

DESCRIPTION OF PREFERRED EMBODIMENTS

Figure 1:
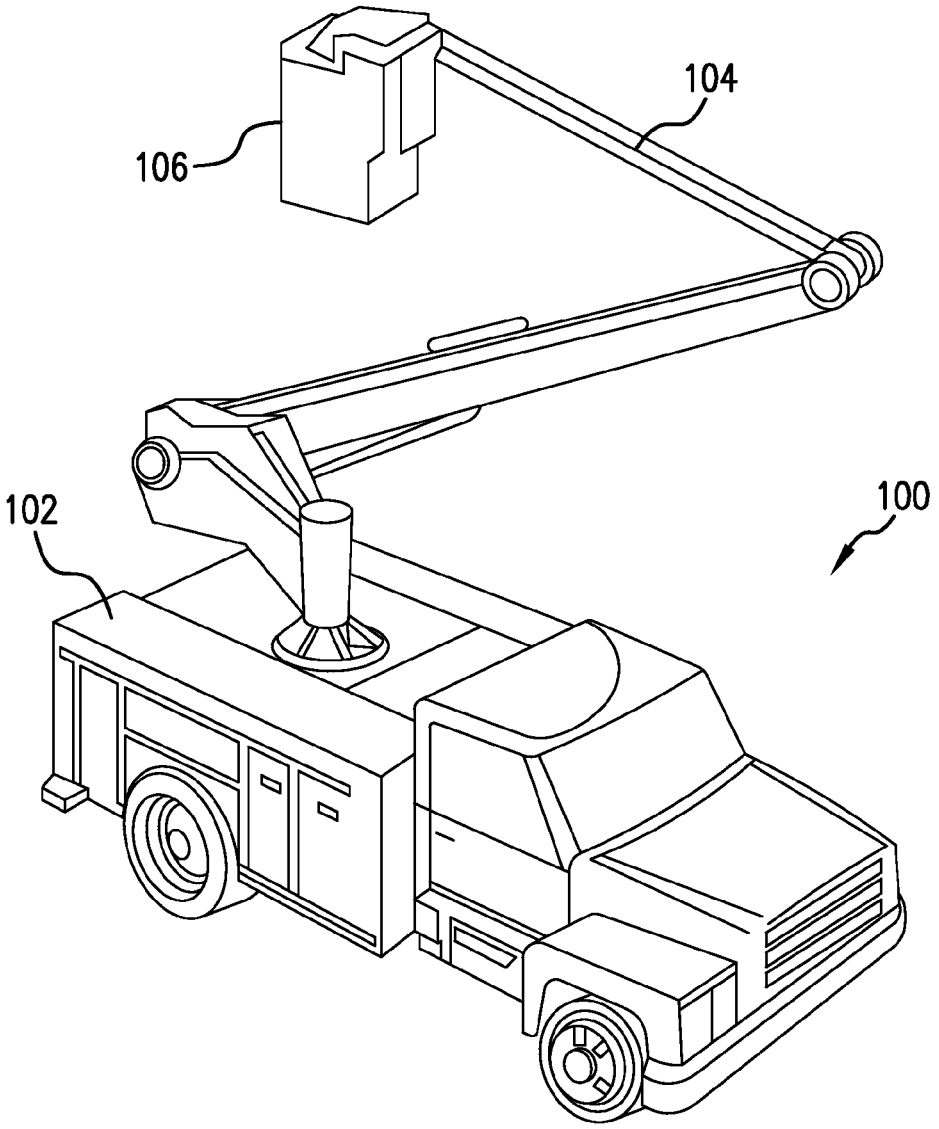
FIG. 1 illustrates an exemplary aerial lift vehicle.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

FIG. 1 illustrates an exemplary aerial lift vehicle which in this case is a bucket truck 100. The bucket truck 100 includes a truck bed 102, an aerial lift boom 104 and a bucket 106. One end of the aerial lift boom 104 is coupled to the truck bed 102 and the opposite end of the aerial lift boom 104 is coupled to the bucket 106. When the boom 104 is in a lowered position (the boom 104 adjacent to the truck bed 102), a worker can get into the bucket 106. The boom 104 can then be raised to elevate the bucket 106 to a desired position to enable the worker to work on elevated objects, for example overhead power lines, lights or trees.

Figure 2:
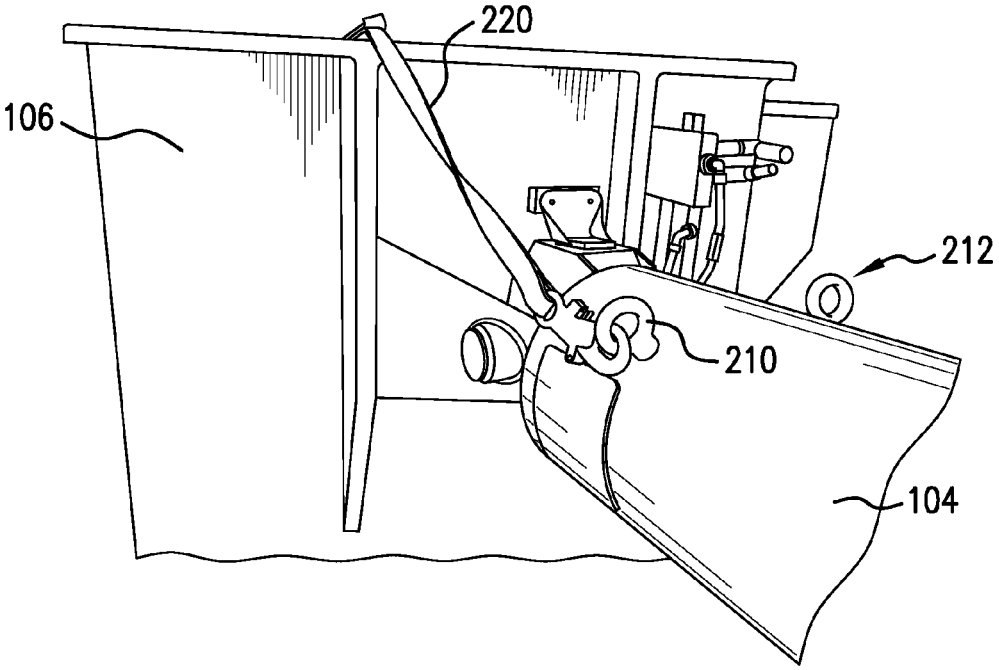
FIG. 2 shows a close up view of the connection between the bucket and the aerial lift boom of an exemplary aerial lift.

When working in aerial lifts, such as the bucket 106, workers must wear a fall restraint system that is connected to an anchorage point. The anchorage point can be on the bucket 106 or on the aerial lift 104 near the bucket 106. FIG. 2 shows a close up view of the connection between the bucket 106 and the aerial lift boom 104. In this embodiment, the boom 104 includes two anchorage points 210 and 212. A fall protection lanyard 220 can be fastened to one of the anchorage points 210 or 212. The other end of the lanyard can be connected to a harness worn by a worker working in the bucket 106. The lanyard 220 will restrain the workers fall if the worker falls from the bucket 106.

Figure 3:
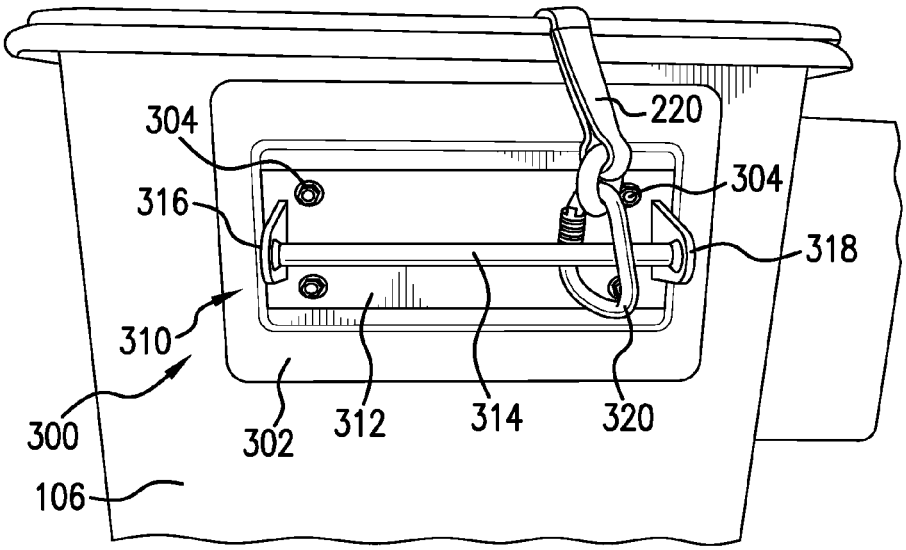
FIG. 3 shows an exemplary embodiment of a fall protection device attached to the bucket of an aerial lift.

FIG. 3 shows an exemplary embodiment of a fall protection device 300 attached to the bucket 106. The fall protection device 300 includes a mounting plate 302 connected to the bucket 106, and a slide bar anchorage device 300 connected to the mounting plate 302. Alternatively, the slide bar anchorage device 300 can be connected directly to the bucket 106 without the use of the mounting plate 302. The slide bar anchorage device 300 includes a base plate 312, a slide bar 314, a left stanchion 316 and a right stanchion 318. The base plate 312 is attached to the base ends of the left and right stanchions 316, 318; and the slide bar 314 is attached to the upper ends of the left and right stanchions 316, 318. One or more fastening mechanisms 304 are used to attach the slide bar anchorage device 300 to the mounting plate 302 and the bucket 106. The mounting plate 302 can be made of an insulating material and can be bonded to the bucket 106 using a high performance bonding agent, for example methyl methacrylate. The fastening mechanisms 304 can be bolts (as shown) or other mechanical, adhesive or other fastening mechanism. When the fastening mechanisms 304 are bolts, the bolts can be part of the mounting plate 302, and another fastening mechanism (for example, an adhesive) can be used to attach the mounting plate 302 to the bucket 106. The mounting plate 302 and/or base plate 312 may be bonded to any surface on an aerial lift bucket or other aerial lift device.

As shown in FIG. 3, a lanyard coupler 320, for example a carabiner, can couple the lanyard 220 to the slide bar 314. The coupling mechanism 320 can move along the length of the slide bar 314 between the left and right stanchions 316, 318 providing the worker greater freedom of movement. The length of the slide bar anchorage device 300 and the slide bar 314 can be designed to allow the desired freedom of movement. Alternatively, a slide bar anchorage device 300 can be installed on multiple sides of the bucket 106 to allow the worker to select the appropriate slide bar anchorage device 300 that will provide the greatest freedom of movement based on the work location.

Figure 4:
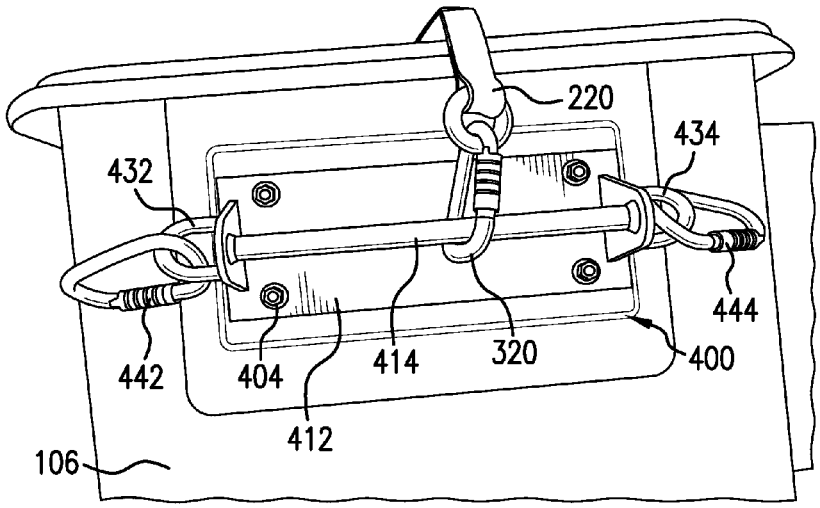
FIG. 4 shows a front view of another exemplary embodiment of a slide bar anchorage device attached to a bucket of an aerial lift.
Figure 5:
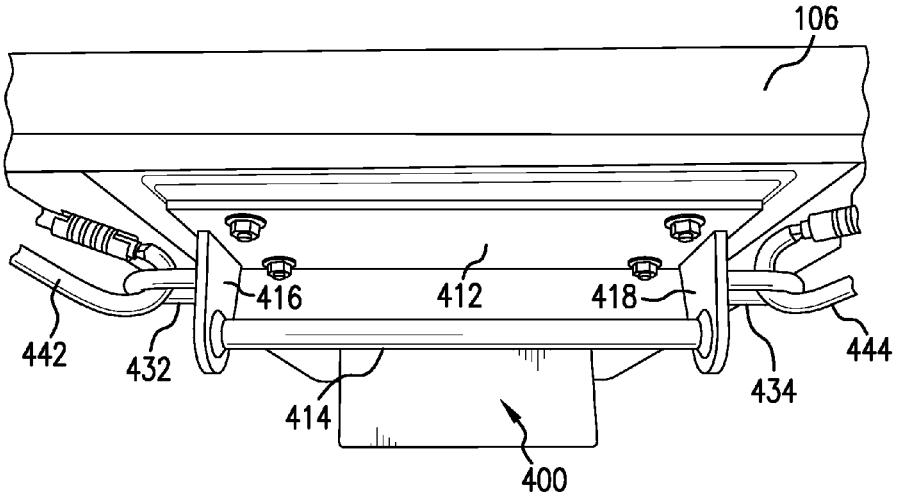
FIG. 5 shows a top view of the slide bar anchorage device of FIG. 4 attached to the bucket of an aerial lift.

FIGS. 4 and 5 show front and top views, respectively, of another exemplary embodiment of a slide bar anchorage device 400 attached to a bucket 106. The slide bar anchorage device 400 includes a base plate 412, a slide bar 414, a left stanchion 416 and a right stanchion 418. The base plate 412 is attached to the base ends of the left and right stanchions 416, 418; and the slide bar 414 is attached to the upper ends of the left and right stanchions 416, 418. One or more fastening mechanisms are used to attach the slide bar anchorage device 400 to the bucket 106. The slide bar anchorage device 400 can also include one or more supplementary anchorage points. The embodiment shown in FIGS. 4 and 5 includes a first supplementary anchorage point 432 and a second supplementary anchorage point 434. The first supplementary anchorage point 432 is attached to the left stanchion 416, and the second supplementary anchorage point 434 is attached to the right stanchion 418. By using additional coupling devices 442, 444 and lanyards attached thereto, these supplementary anchorage points 432, 434 can be connected to additional anchorage points for secondary fall protection/restraint. For example, nylon straps connected to the clip devices 442, 444 can be connected to one or both of the boom anchorage points 210, 212. Connecting the supplementary anchorage points 432, 434 to the boom anchorage points 210, 212 provides anchorage points for the slide bar anchorage device 400 that are independent of the bucket 106 providing enhanced safety for the worker. For example, even if the bucket 106 were to break from the boom 104, nylon straps attached to the supplementary anchorage points 432, 434 can still provide fall protection/restraint for the worker. A ratchet device may be used to tighten the nylon straps attached to the supplementary anchorage points 432, 434 to a desired tension/length.

Figure 6:
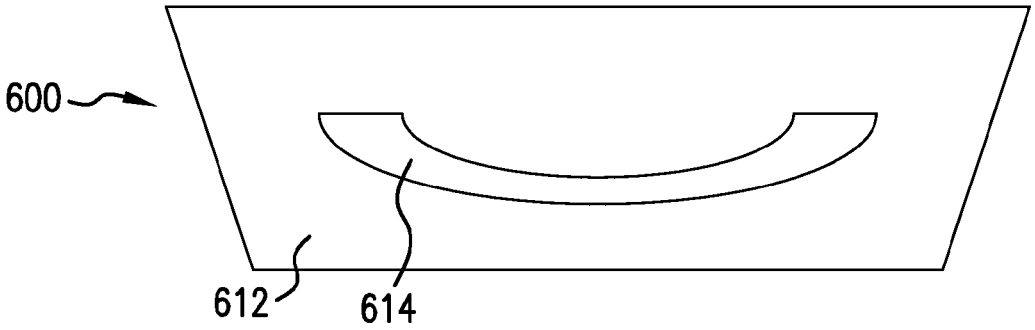
FIG. 6 illustrates another exemplary embodiment of a slide bar anchorage device with a U-shaped slide bar.

FIG. 6 illustrates another exemplary embodiment of a slide bar anchorage device 600 that can be attached to a bucket 106. The slide bar anchorage device 600 includes a base plate 612 and a slide bar 614. The slide bar 614 is generally U-shaped with the two ends of the U-shape being attached to the base plate 612. One or more fastening mechanisms can be used to attach the slide bar anchorage device 600 to the bucket 106. The slide bar anchorage device 600 can also include one or more supplementary anchorage points connected to the base plate 612. A lanyard coupler, for example a carabiner, can couple a lanyard 220 to the slide bar 614 and the lanyard coupler can move along the length of the slide bar 614 between where the two ends of the U-shape are attached to the base plate 612. A slide bar can be designed with various different shapes that allow movement of a lanyard coupler along the slide bar.

Figure 7:
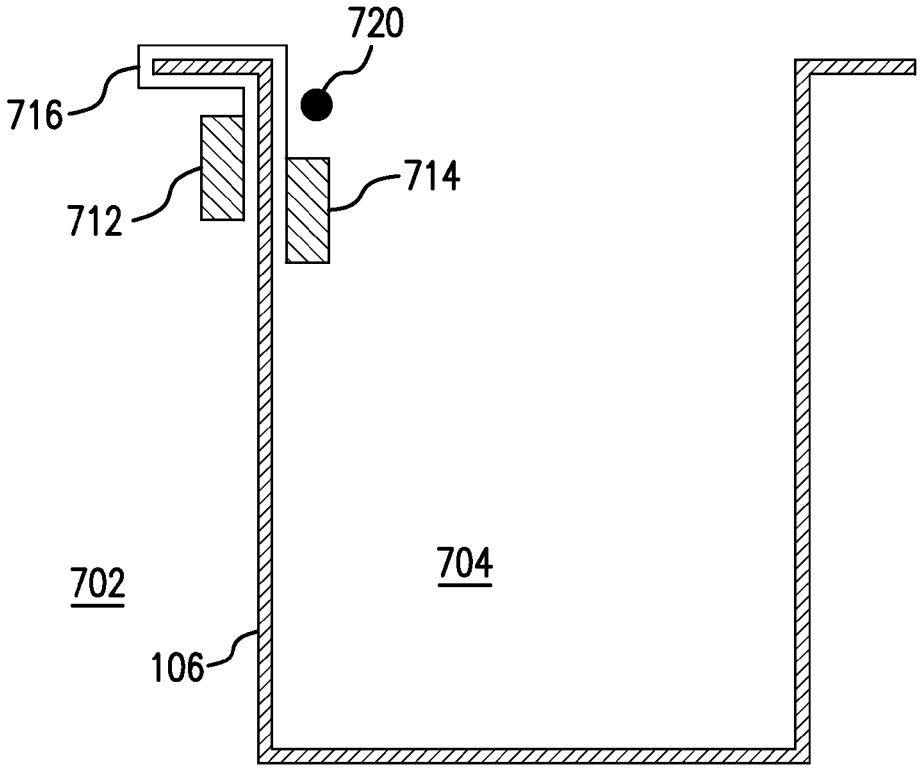
FIG. 7 illustrates a side view of an exemplary embodiment of a slide bar anchorage device that can be attached and detached from a bucket of an aerial lift.
Figure 8:
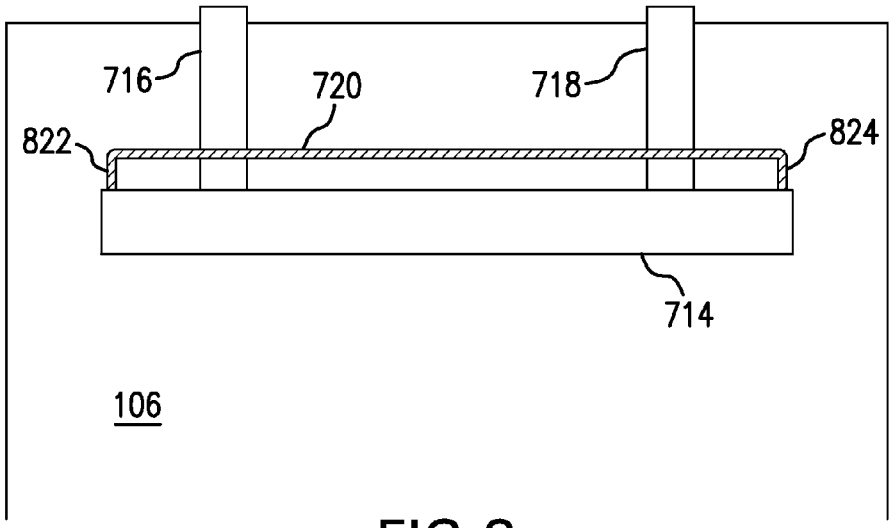
FIG. 8 illustrates a side view of the slide bar anchorage device of FIG. 7 from the inside of the bucket when the slide bar anchorage device is attached to the bucket.
Figure 9:
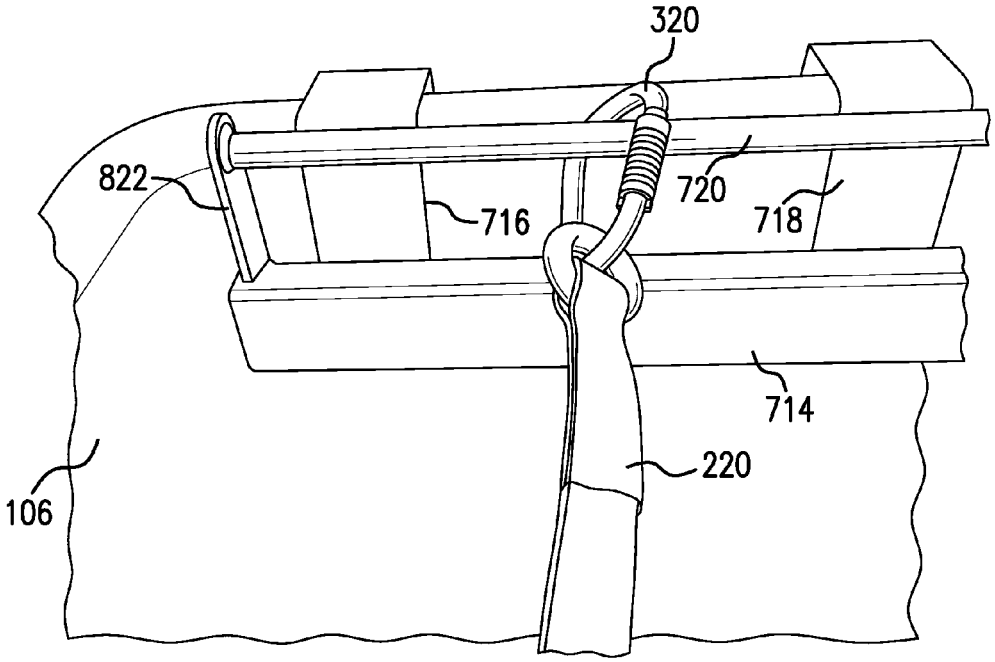
FIG. 9 shows a side view of an exemplary embodiment of the slide bar anchorage device of FIG. 7 from the inside of the bucket when the slide bar anchorage device is attached to the bucket.
Figure 10:
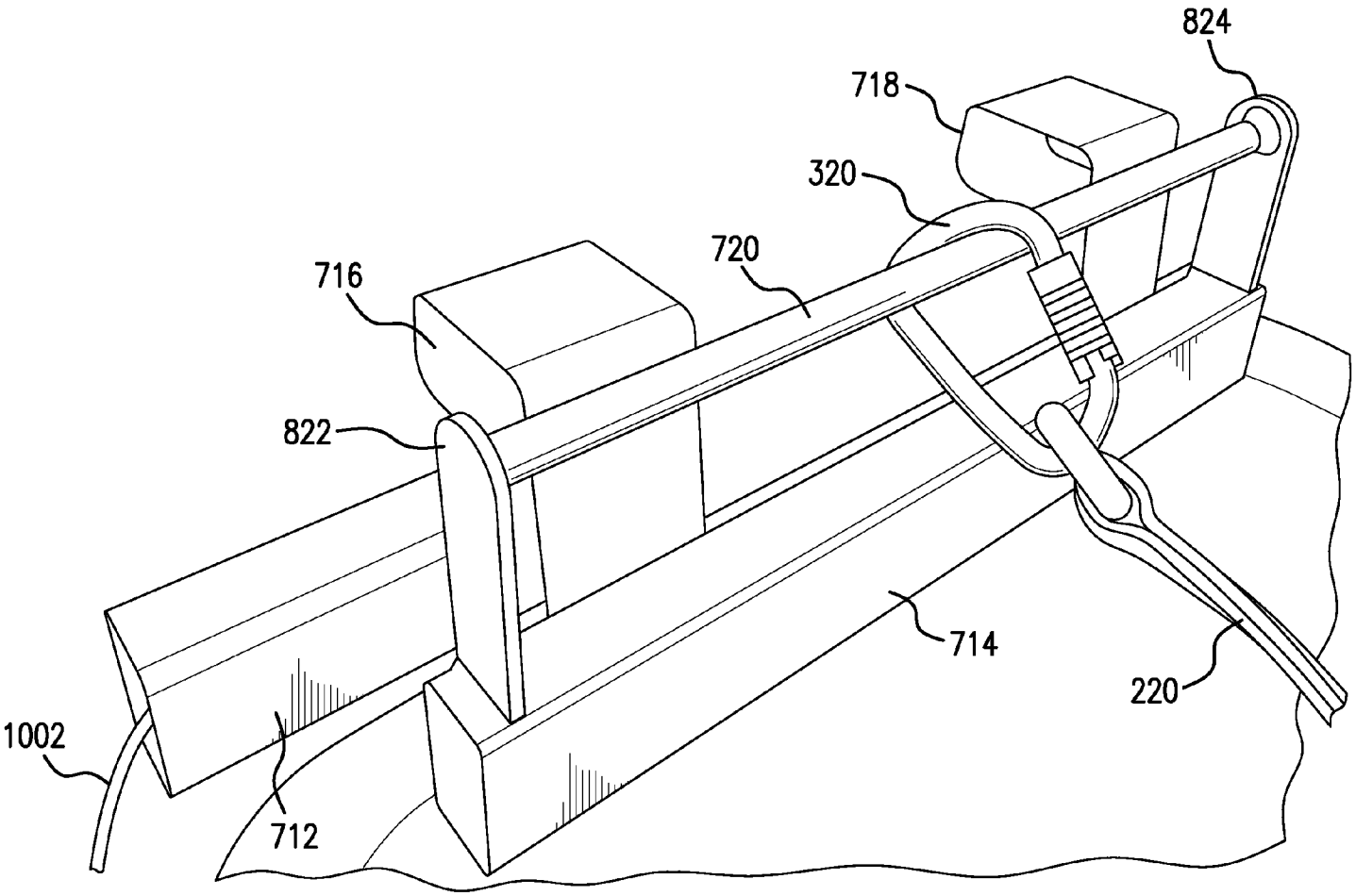
FIG. 10 shows the exemplary embodiment of the slide bar anchorage device of FIG. 9 when the slide bar anchorage device is not attached to the bucket.

FIGS. 7-10 illustrate another exemplary embodiment of a slide bar anchorage device 700 that can be removably attached to a bucket 106. FIG. 7 illustrates a side view of the slide bar anchorage device 700, FIG. 8 illustrates a side view of the slide bar anchorage device 700 from the inside of the bucket 106, FIG. 9 shows a side view of an exemplary embodiment of the slide bar anchorage device 700 from the inside of the bucket 106, and FIG. 10 shows the exemplary embodiment of the slide bar anchorage device 700 not connected to the bucket 106. The slide bar anchorage device 700 includes an outer mounting bar 712, an inner mounting bar 714 and at least two bucket engaging brackets 716, 718 connecting the outer mounting bar 712 to the inner mounting bar 714. The bucket engaging brackets 716, 718 are shaped to fit over the lip of the bucket 106 such that the slide bar anchorage device 700 can be removably attached (attached and detached) to the bucket 106. The slide bar anchorage device 700 also includes right and left stations 822, 824 the bases of which are attached near opposite ends of the inner mounting bar 714. A slide bar 720 is attached to the upper ends of the right and left stations 822, 824 such that a lanyard coupler 320 can couple a lanyard 220 to the slide bar 720 and the lanyard coupler 320 can move along the length of the slide bar 720 between the left and right stanchions 822, 824 providing the worker greater freedom of movement. However, the structure of the slide bar anchorage device 700 is also designed such that it does not detach from the bucket 106 if the worker is ejected from the bucket 106. The slide bar anchorage device 700 can also include supplementary anchorage points to connect the slide bar anchorage device 700 to additional anchorage points, for example one or more of the boom anchorage points 210, 212. The outer and inner mounting bars 712, 714 can be solid or hollow. If the mounting bars 712, 714 are hollow, a lanyard or cable 1002 can pass through at least one of the mounting bars 712, 714 and connect to an independent anchorage point, for example one or more of the boom anchorage points 210, 212, to provide backup fall protection/restraint for the worker.

The slide bar anchorage device provides alternative or additional anchorage points for fall protection/restraint while working in an aerial lift bucket truck or any other type of aerial lift device. The current factory-installed boom anchorage points limit a worker's ability to move around to perform work from the bucket. The slide bar anchorage device provides an additional anchorage point for the worker's use other than the boom anchorage points. The slide bar anchorage device allows greater freedom of movement for the worker while using a shorter fall protection/restraint lanyard. The slide bar anchorage device can be mounted inside or outside a bucket or lift system. The slide bar anchorage device can be mounted to the floor or walls of a bucket, or lift system, and can be designed as large or as small as needed. The slide bar anchorage device can be made to meet fall protection requirements, for example to support a required weight. The attachment of the slide bar anchorage device to the aerial lift and the slide bar for a worker's lanyard attachment can be designed to be strong enough to support the worker's weight according to national standards.

Two or more slide bar anchorage devices may be mounted side-by-side and/or connected together if desired. For example, two slide bar anchorage devices 400 can be mounted side-by-side and the middle supplementary anchorage points (supplementary anchorage point 444 of the left slide bar anchorage device 400 and supplementary anchorage point 442 of the right slide bar anchorage device 400) can be connected using a coupling device, for example a carabiner.

The slide bar anchorage device provides an anchorage point for workers to use that allows greater freedom of movement for the worker while being in compliance with the revised OSHA regulations. By April 2015, a worker must wear a full body harness with a safety lanyard that is short enough not to allow the worker to fall more than six feet or to contact a lower surface when working from an aerial lift if ejected from the bucket or any other type of aerial lift device. The anchorage point currently used by workers is typically installed by the aerial lift manufacturer, and would not allow the worker to comfortably perform work while using the shorter lanyard that would be required for compliance with the revised OSHA regulations. The slide bar anchorage device allows the worker to wear a harness and lanyard connected to the slide bar on the slide bar anchorage device, which can protect the worker from a six-foot fall or from contacting a lower surface if ejected from the aerial lift. The slide bar anchorage system can be used by workers, for substation building and maintenance, or different types of aerial and scissor lifts such as those used by home improvement stores or other warehouse/stores, etc.

Embodiments of the slide bar anchorage device can be mounted or attached in various locations to provide an anchorage point on the inside or the outside of the bucket, or the sides or floor of the bucket or the aerial lift. The slide bar anchorage device can be coated or treated with a material that protects the worker from hazards, for example electric current. A bonding agent can be used to secure the slide bar anchorage system to the bucket or the aerial lift. A fiberglass or other shielding device can be constructed to cover the side bar anchorage device to protect the worker from electrical equipment or conductors. The slide bar anchorage device may be coated with rubber or other electrically-insulated materials if desired. Alternatively, the slide bar anchorage device may be made using a high strength insulated material strong enough to meet national standards for worker's use. Fiberglass or other materials may be used to cover all or parts of the slide bar anchorage device to act as a shield and protect the worker from electrical equipment, conductors or other hazards as needed.

The slide bar may be welded to the base plate or housing with metal stantions or spacers on each end of the bar that provide a gap between the base plate and the slide bar. This gap between the base plate and the slide bar may be varied depending on the desired design and application.

While exemplary embodiments incorporating the principles of the present invention have been disclosed, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

I claim:

1. An anchorage device for attachment to an aerial lift where the aerial lift includes a boom and a bucket configured to hold a worker, the boom having a first boom anchorage point and a second boom anchorage point, the bucket having a boom side and a non-boom side, the boom being directly attached to the boom side of the bucket and the boom not being directly attached to the non-boom side of the bucket, the anchorage device comprising:

a base plate for coupling to the bucket of the aerial lift, the base plate being attached to the non-boom side of the bucket;

a slide bar having a length between a first end and a second end, the first and second ends of the slide bar being coupled to the base plate;

a first stanchion having a proximal end and a distal end;

a second stanchion having a proximal end and a distal end, the proximal ends of the first and second stanchions being attached to the base plate, the first end of the slide bar being attached to the distal end of the first stanchion, and the second end of the slide bar being attached to the distal end of the second stanchion;

a first supplementary anchorage point coupled to the base plate and configured for attaching to the first boom anchorage point using a first supplementary lanyard, the first supplementary anchorage point being attached to the first stanchion between the proximal and distal ends of the first stanchion; and a second supplementary anchorage point attached to the second stanchion between the proximal and distal ends of the second stanchion, the second supplementary anchorage point being configured for attaching to the second boom anchorage point using a second supplementary lanyard;

wherein the slide bar allows a lanyard coupler attached to the slide bar to slide along the length of the slide bar between the distal end of the first stanchion at the first end of the slide bar and the distal end of the second stanchion at the second end of the slide bar, wherein if the base plate detaches from the bucket when the first supplementary lanyard is attached between the first supplementary anchorage point and the first boom anchorage point, the first supplementary lanyard restrains falling of the anchorage device; and if the base plate detaches from the bucket when the second supplementary lanyard is attached between the second supplementary anchorage point and the second boom anchorage point, the second supplementary lanyard restrains falling of the anchorage device.

2. The anchorage device of claim 1, wherein the slide bar is U-shaped.

3. The anchorage device of claim 1, wherein the slide bar is coated with an insulating material.

4. The anchorage device of claim 1, wherein the base plate is coupled to the outside of the bucket.

5. The anchorage device of claim 1, wherein the base plate is coupled to the inside of the bucket.

6. The anchorage device of claim 1, wherein the base plate is coupled to the bucket using an adhesive.

7. The anchorage device of claim 1, further comprising a mounting plate, the mounting plate being attached to the bucket, the base plate being attached to the mounting plate.

8. The anchorage device of claim 7, wherein the mounting plate is attached to the bucket using an adhesive.

9. The anchorage device of claim 8, wherein the base plate is attached to the mounting plate using bolts.

* * * * *